US010361522B2

(12) United States Patent
Paynter et al.

(10) Patent No.: US 10,361,522 B2
(45) Date of Patent: Jul. 23, 2019

(54) INNER CONTACT FOR COAXIAL CABLE

(71) Applicant: CommScope Technologies LLC, Hickory, NC (US)

(72) Inventors: Jeffrey D. Paynter, Momence, IL (US); James P. Fleming, Orland Park, IL (US); Frank A. Harwath, Naperville, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/012,121

(22) Filed: Jun. 19, 2018

(65) Prior Publication Data

US 2019/0006797 A1 Jan. 3, 2019

Related U.S. Application Data

(60) Provisional application No. 62/526,455, filed on Jun. 29, 2017.

(51) Int. Cl.

| | |
|---|---|
| ***H01R 24/56*** | (2011.01) |
| ***H01R 13/24*** | (2006.01) |
| ***H01R 13/187*** | (2006.01) |
| ***H01R 9/05*** | (2006.01) |
| *H01R 13/11* | (2006.01) |
| *H01R 4/48* | (2006.01) |

(52) U.S. Cl.

CPC ..... *H01R 24/564* (2013.01); *H01R 9/05* (2013.01); *H01R 13/187* (2013.01); *H01R 13/2407* (2013.01); *H01R 4/48* (2013.01); *H01R 13/111* (2013.01); *H01R 24/56* (2013.01)

(58) Field of Classification Search

CPC ..... H01R 24/564; H01R 13/111

USPC ..... 439/578

See application file for complete search history.

(56) References Cited

U.S. PATENT DOCUMENTS 4,561,716 A * 12/1985 Acke ..... H01R 24/40 439/578

4,932,897 A * 6/1990 Lee ..... H01R 24/40 439/578

5,316,494 A 5/1994 Flanagan et al.

(Continued)

FOREIGN PATENT DOCUMENTS

KR 1020060097671 9/2006

WO 2014/116338 7/2014

OTHER PUBLICATIONS

Notification of Transmittal of the International Search Report and the Written Opinion of the International Searching Authority, or the Declaration corresponding to International Application No. PCT/US2018/038157 dated Oct. 8, 2018.

*Primary Examiner* — Tulsidas C Patel

*Assistant Examiner* — Peter G Leigh

(74) *Attorney, Agent, or Firm* — Myers Bigel, P.A.

(57) ABSTRACT

An inner contact for a coaxial connector includes: an elongate, generally cylindrical body having a longitudinal axis and first and second opposed ends; and a plurality of spring fingers extending from the first end of the body generally parallel to the longitudinal axis, each of the spring fingers having a projection extending radially inwardly from a free end thereof. Each spring finger is separated from each of its immediately adjacent spring fingers by a slot. Each of the projections has opposed side edge portions, and wherein the side edge portions incline with increasing distance from an adjacent slot.

14 Claims, 3 Drawing Sheets

(56) References Cited

U.S. PATENT DOCUMENTS

| | | | | |
|---|---|---|---|---|
| 5,435,745 | A * | 7/1995 | Booth | H01R 9/0521 439/583 |
| 5,564,942 | A * | 10/1996 | Lee | H01R 9/0521 439/462 |
| 6,450,829 | B1 * | 9/2002 | Weisz-Margulescu | H01R 13/424 439/263 |
| 7,335,065 | B1 * | 2/2008 | Chen | H01R 13/6272 439/654 |
| 7,347,129 | B1 * | 3/2008 | Youtsey | B25B 13/06 81/124.2 |
| 7,621,778 | B1 | 11/2009 | Paynter et al. | |
| 8,075,338 | B1 * | 12/2011 | Montena | H01R 24/40 439/578 |
| 8,241,060 | B2 * | 8/2012 | Sykes | H01R 24/40 439/316 |
| 9,009,960 | B2 * | 4/2015 | Vaccaro | H01R 13/111 29/874 |
| 9,017,102 | B2 * | 4/2015 | Natoli | H01R 9/0524 439/578 |
| 9,071,019 | B2 * | 6/2015 | Burris | H01R 13/639 |
| 9,419,351 | B2 * | 8/2016 | Vaccaro | H01R 13/111 |
| 9,559,458 | B2 * | 1/2017 | Zhang | |
| 2002/0076964 | A1 * | 6/2002 | Weisz-Margulescu | H01R 13/424 439/263 |

* cited by examiner

INNER CONTACT FOR COAXIAL CABLE

RELATED APPLICATION

The present application claims the benefit of and priority from U.S. Provisional Patent Application No. 62/526,455, filed Jun. 29, 2017, the disclosure of which is hereby incorporated herein in its entirety.

FIELD OF THE INVENTION invention is directed generally to electrical cable connectors, and more particularly to coaxial connectors for electrical cable.

BACKGROUND

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an electronic apparatus or on another cable. Typically, one connector will include a structure such as a pin or post connected to an inner conductor of the coaxial cable and an outer conductor connector body connected to the outer conductor of the coaxial cable these are mated with a mating sleeve (for the pin or post of the inner conductor) and another outer conductor connector body of a second connector. Coaxial connector interfaces often utilize a threaded coupling nut or other, retainer that draws the connector interface pair into secure electro-mechanical engagement when the coupling nut (which is captured by one of the connectors) is threaded onto the other connector.

Passive intermodulation Distortion (PIM) is a form of electrical interference/signal transmission degradation that may occur with less than symmetrical interconnections and/or as electro-mechanical interconnections shift or degrade over time. Interconnections may shift due to mechanical stress, vibration, thermal cycling, and/or material degradation. PIM can be an important interconnection quality characteristic, as PIM generated by a single low quality interconnection may degrade the electrical performance of an entire RF system. Thus, the reduction of PIM via connector design is typically desirable.

SUMMARY

As a first aspect, embodiments of the invention are directed to an inner contact for a coaxial connector. The inner contact comprises: an elongate, generally cylindrical body having a longitudinal axis and first and second opposed ends; and a plurality of spring fingers extending from the first end of the body generally parallel to the longitudinal axis, each of the spring fingers having a projection extending radially inwardly from, a free end thereof. Each spring finger is separated from each of its immediately adjacent spring fingers by a slot. Each of the projections has opposed side edge portions, and wherein the side edge portions incline with increasing distance from an adjacent slot.

As a second aspect, embodiments of the invention are directed to a method of forming an inner contact for a coaxial connector, comprising the steps of: (a) providing a preform having an elongate, hollow, generally cylindrical body having a longitudinal axis and first and second opposed ends, the body having a radially-inward projection adjacent the first end; (b) forming a plurality of recesses in the projection; and (c) forming a plurality of slots in the first end to provide a plurality of spring fingers, wherein each of the slots is formed through a respective recess.

DETAILED DESCRIPTION

Figure 1:
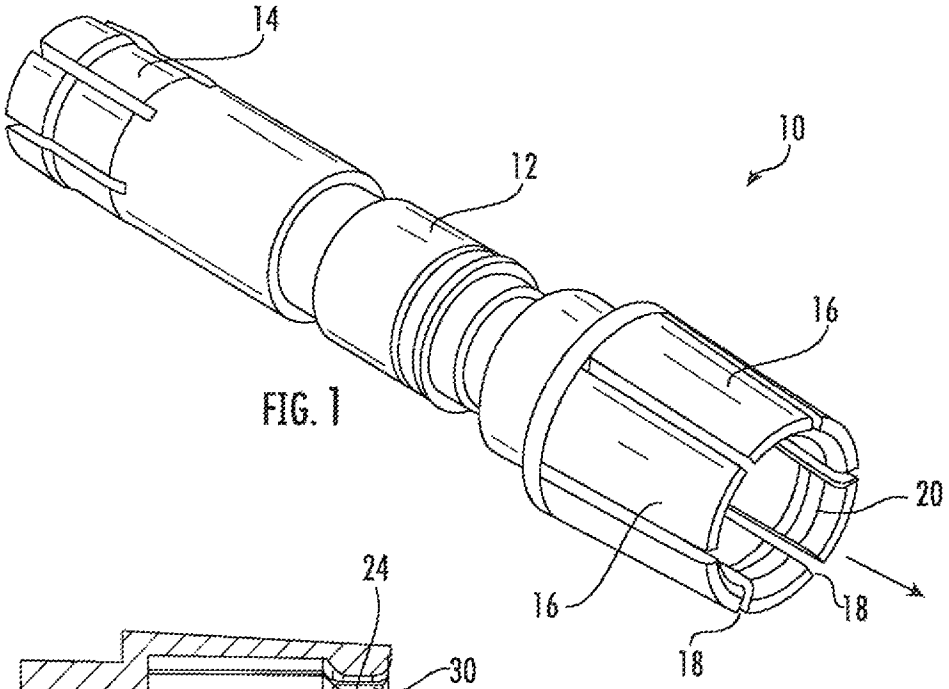
FIG. 1 is a perspective view of an inner contact for a coaxial connector according to embodiments of the invention.

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Field-fit coaxial connectors that are terminated onto the end of a coaxial cable require a contact between the inner conductor of the cable and the inner contact of the connector. This interconnection is often accomplished with a "spring basket" design, in which the end of the contact has multiple fingers or tines that encircle the end of the inner conductor of the cable and form an interference-fit joint.

The tines of the spring basket are typically formed by cutting multiple slots axially through a tube with a thin saw blade. The tines are sized to create the aforementioned interference fit with the cable inner conductor. However, when these tines are formed via sawing, the edges can be very sharp and often contain sharp burrs. These sharp edges can cut into the soft copper of the cable inner conductor, creating metal debris in the current path which in turn causes PIM.

Referring now to the figures, a contact that may address these potential PIM issues is illustrated in FIGS. 1-4 and designated broadly at 10. The contact 10 includes an elongate, hollow, generally cylindrical body 12 with a number of radial recesses and projections. At one end, the contact 10 includes tines 14 that are configured to mate with an inner contact of a mating connector. At the opposite end, the contact 10 includes six spring fingers 16, separated by six slots 18, that are configured to mate with the end of an inner conductor of a coaxial cable via an interference fit. The spring fingers 16 are discussed in greater detail below.

Figure 2:
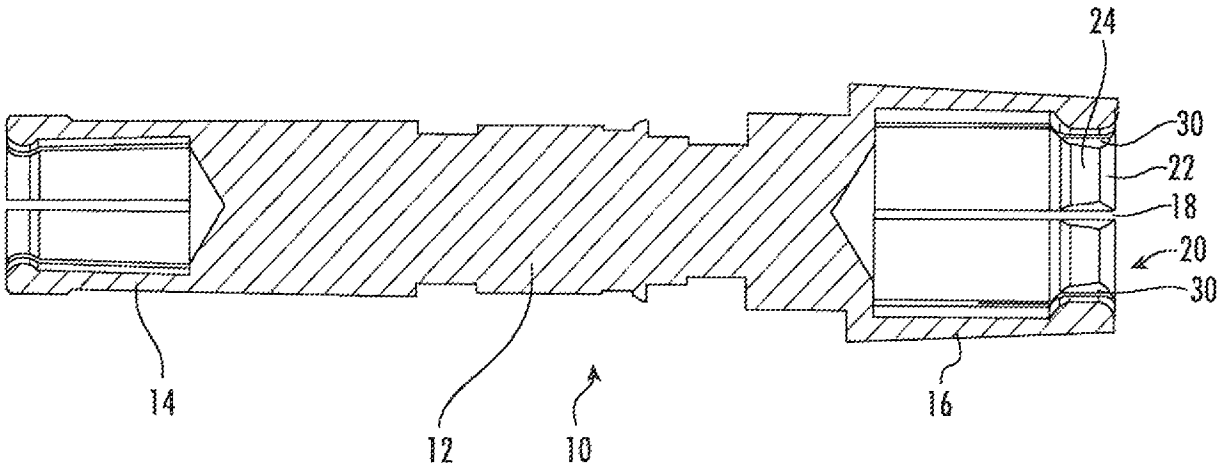
FIG. 2 is a side section view of the inner contact of FIG. 1.
Figure 3:
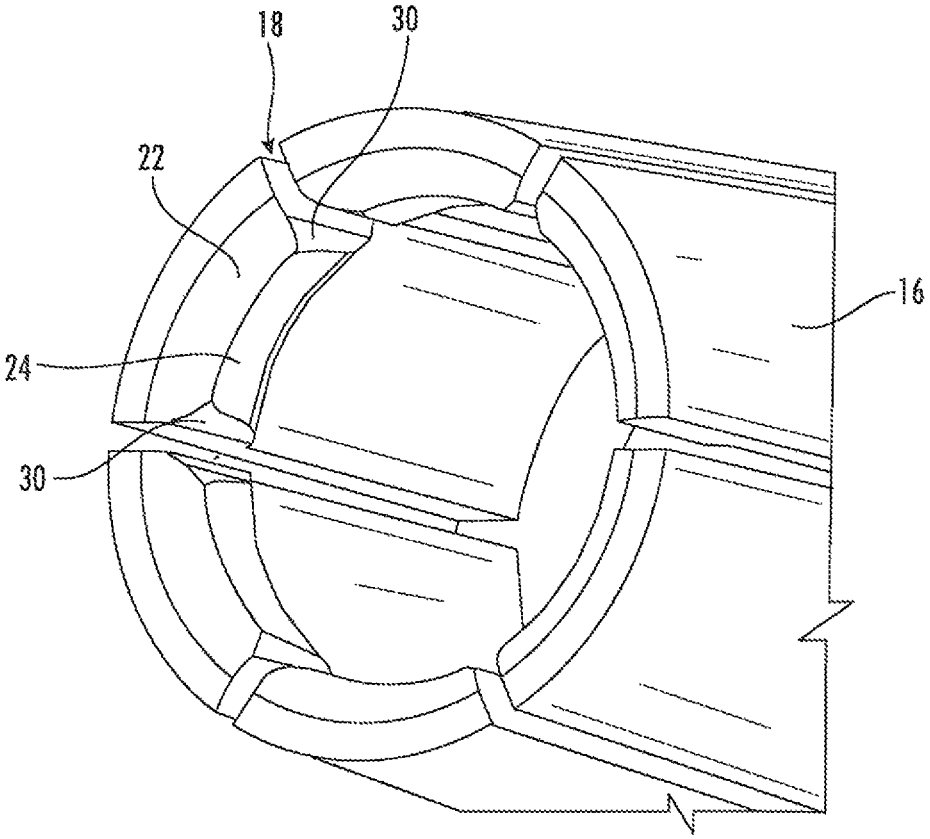
FIG. 3 is an enlarged partial perspective view of the free ends of the spring fingers of the inner contact of FIG. 1.
Figure 4:
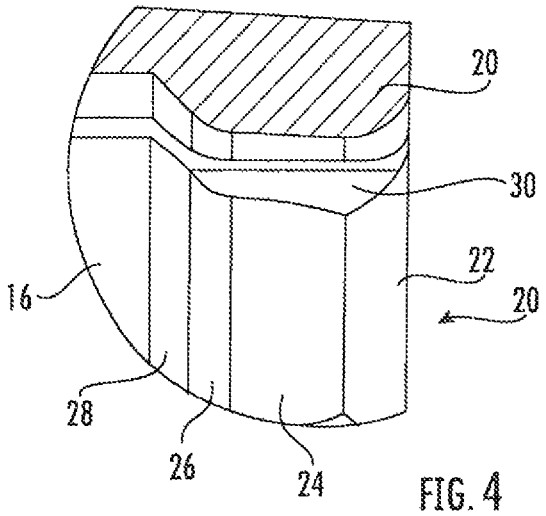
FIG. 4 is an enlarged partial side section view of the free ends of the spring fingers of FIG. 3.

Referring to FIGS. 2-4, at its free end each tine 16 has a projection 20 that extends radially inward. The projections 20 are generally pentagonal in cross-section, with a distal surface 22, a longer intermediate surface 24, a shorter intermediate surface 26, and a shortest near surface 28 comprising a multi-face surface inner surface; the projections 20 is at their widest points at the intersection of the distal and longer intermediate surfaces 22, 24. As can be seen in FIGS. 3 and 4, the circumferential edge portions 30 of the projections 20 incline with increasing distance from their adjacent slots 18; in some embodiments, the edge portions 30 are arcuate (e.g., radiused or filleted). To give a sense of scale, the projection 20 extends radially inwardly about 0.4 mm and is about 1.5 mm in length.

The presence of the inclined edge portions 30 can help to prevent the generation of unwanted PIM when the contact 10 is connected to the inner conductor of a cable. As discussed above, such PIM can be generated by the scratching/scraping/abrading of sharp edges of the tines formed by sawing. Because the edge portions 30 of the projections 20 are inclined, the locations of the spring fingers 16 that would otherwise have sharp edges are absent. As a result, there are no sharp edges to deleteriously interact with the cable inner conductor, thereby reducing the likelihood of PIM being generated due to the sharp edges.

Figure 5:
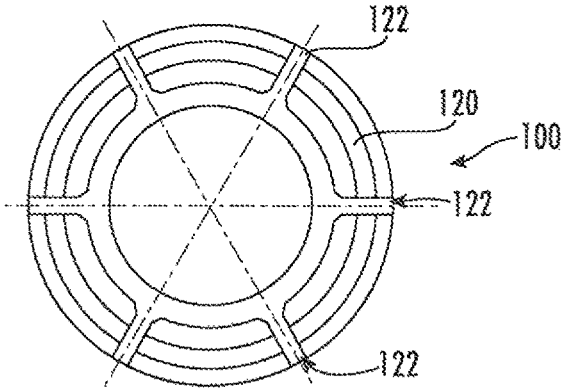
FIG. 5 is an end view of a preform used to make the inner contact of FIG. 1 prior to the forming of slots between the spring fingers.
Figure 6:
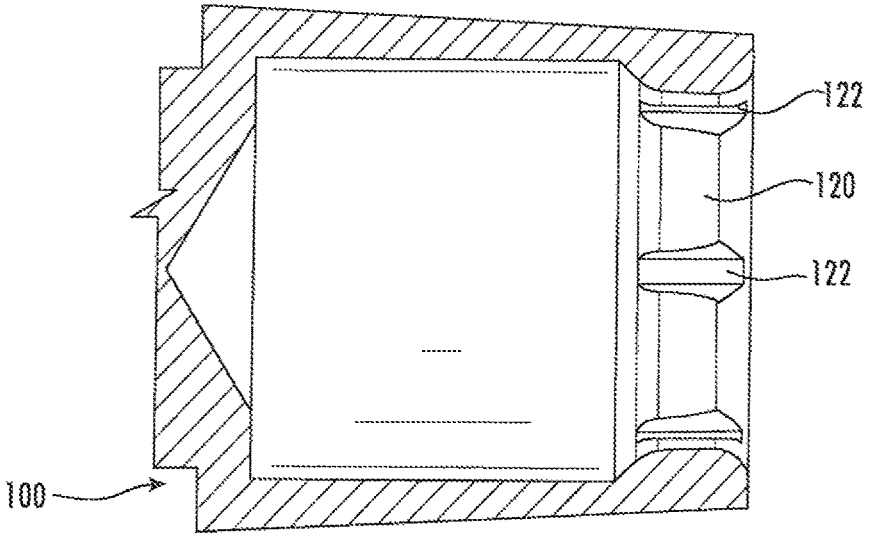
FIG. 6 is an enlarged partial perspective view of the end of the preform of FIG. 5.
Figure 7:
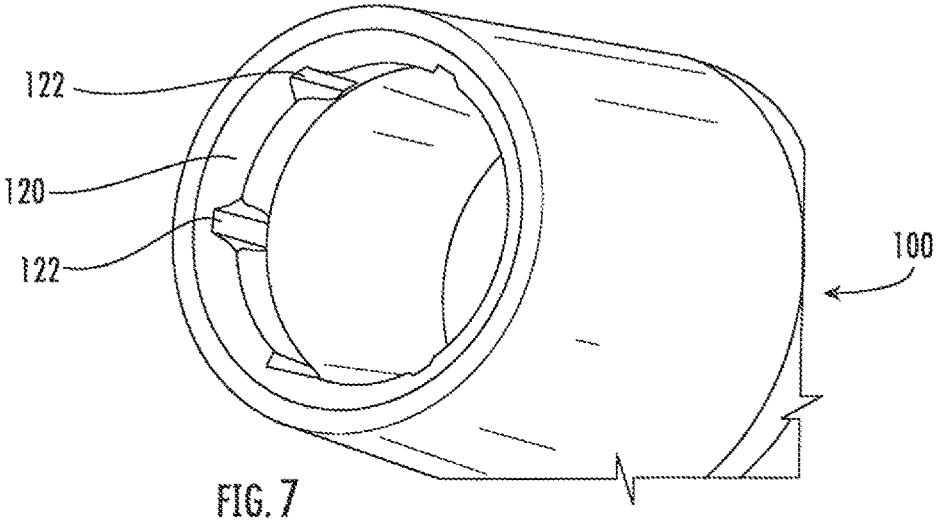
FIG. 7 is an enlarged internal section view of the end of the preform of FIG 6.

Referring now to FIGS. 5-7, one manner of forming the spring fingers 16 of the contact 10 is illustrated therein. An elongate, hollow, generally cylindrical preform 100 of the contact 10 can be formed by any of several methods, including casting and machining. The preform 100 has a circumferential projection 120 similar in cross-section to the projection 20 discussed above. The preform 100 is then subjected to a broach cut or other operation that forms recesses 122 in the projection 120. The recesses 122 are located wherever a slot is to be formed (for example, in FIG. 5, there are six recesses 122 formed at 60 degree intervals around the inner circumference of the preform 110).

Slots are then formed in the preform 100 through the recesses 122 in a conventional manner, such as by sawing with a thin slaw blade, to produce the contact 10. The deleterious sharp edges of the prior art tines discussed above appear at the circumferential edges of the projections of the tines; however, because in the contact 10 these areas are no longer present (having been removed in the formation of the recesses 122), the resulting contact 10 has spring fingers 16 with projections 20 having inclined edges portions 130 rather than sharp edges in these locations. As a result, attachment of the contact 10 with the end of a cable inner conductor is unlikely to scrape, scratch or abrade the inner conductor in a mariner that produces unwanted PIM.

As an alternative, the inner contact 10 may also be formed by first forming slots in one end to create spring fingers, then using a broach tool or other implement to form the inclined edge portions 30. Doing so can remove any burrs remaining from the edges of the spring fingers. If this sequence is followed, it may be advantageous to surround the outer diameter of the slotted fingers with a sleeve prior to broaching to maintain the fingers in position.

The inner contact 10 is typically formed of phosphor bronze, but may be formed of any material that can conduct electrical signals from the inner conductor of the cable to a mating inner contact.

Those skilled in this art will appreciate that, although the spring fingers 16 are shown herein as providing an interface with the inner conductor of a coaxial cable, other instances in which spring fingers or tines are employed to create a joint or interface may also benefit from the concepts discussed above. For example, the tines 14 on the opposite end of the contact 10 may include projections with inclined side edge portions. Other connectors that employ spring fingers or s spring basket to make electrical contact may also realize advantages to similarly configured spring fingers.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An inner contact for a coaxial connector, comprising:

an elongate, generally cylindrical body having a longitudinal axis and first and second opposed ends;

a plurality of spring fingers extending from the first end of the body generally parallel to the longitudinal axis, each of the spring fingers having a projection extending radially inwardly from a free end thereof;

wherein each spring finger is separated from each of its immediately adjacent spring fingers by a slot;

wherein each of the projections has opposed side edge portions, and wherein the side edge portions incline with increasing distance from an adjacent slot, wherein each projection is pentagonal in cross-section having a multi-face radially inward surface comprising a distal surface, a longer intermediate surface, a shorter intermediate surface, and a shortest near surface.

2. The inner contact defined in claim 1, wherein the side edge portions are arcuate.

3. The inner contact defined in claim 1, wherein the side edge portions are fillets.

4. The inner contact defined in claim 1, wherein a second plurality of spring fingers extends from the second end of the body.

5. The inner contact defined in claim 1, in combination with an inner conductor of a coaxial cable, wherein the inner conductor is positioned within and in electrical contact with the projections of the spring fingers.

6. The inner contact defined in claim 1, wherein the widest point of each projection is located at an intersection of the distal surface and the longer intermediate surface.

7. The inner contact defined in claim 1, wherein each projection extends radially inwardly about 0.4 mm and have a length of about 1.5 mm.

8. A method of forming an inner contact for a coaxial connector, comprising the steps of:

(a) providing a preform having an elongate, hollow, generally cylindrical body having a longitudinal axis and first and second opposed ends, the body having a radially-inward projection adjacent the first end, each projection is pentagonal in cross-section having a multi-face radially inward surface comprising a distal surface, a longer intermediate surface, a shorter intermediate surface, and a shortest near surface;

(b) forming a plurality of recesses in the projection; and (c) forming a plurality of slots in the first end to provide a plurality of spring fingers, wherein each of the slots is formed through a respective recess.

9. The method defined in claim 8, wherein the recesses form side edge portions of the spring fingers, and wherein the side edge portions incline with increasing distance from an adjacent slot.

10. The method defined in claim 8, wherein the recesses are formed in step (b) with a broach tool.

11. The method defined in claim 8, wherein the side edge portions are arcuate.

12. The method defined in claim 8, wherein the side edge portions are fillets.

13. The method defined in claim 8, wherein a second plurality of spring fingers extends from the second end of the body.

14. The method defined in claim 8, further comprising the step of (d) inserting an end of an inner conductor of a coaxial cable within the projections of the spring fingers to form a joint between the inner contact and the inner conductor of the cable.

* * * * *